US008622271B2

(12) United States Patent
Shima et al.

(10) Patent No.: US 8,622,271 B2
(45) Date of Patent: Jan. 7, 2014

(54) FASTENER DRIVING TOOL

(75) Inventors: Yukihiro Shima, Hitachinaka (JP); Hiroyuki Oda, Hitachinaka (JP); Yoshihiro Nakano, Hitachinaka (JP); Masahiro Inaniwa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 105 days.

(21) Appl. No.: 12/495,390

(22) Filed: Jun. 30, 2009

(65) Prior Publication Data

US 2009/0321492 A1 Dec. 31, 2009

(30) Foreign Application Priority Data

Jun. 30, 2008 (JP) ..... 2008-171274

(51) Int. Cl.
*B21J 15/28* (2006.01)
*B27F 7/17* (2006.01)

(52) U.S. Cl.
USPC ..... 227/2

(58) Field of Classification Search
USPC ..... 227/1–7
See application file for complete search history.

(56) References Cited

U.S. PATENT DOCUMENTS

| | | | | |
|---|---|---|---|---|
| 3,589,588 | A * | 6/1971 | Vasku | 227/132 |
| 5,495,161 | A * | 2/1996 | Hunter | 318/807 |
| 5,511,715 | A * | 4/1996 | Crutcher et al. | 227/131 |
| 5,919,203 | A * | 7/1999 | Husted et al. | 606/180 |
| 6,598,684 | B2 * | 7/2003 | Watanabe | 173/2 |
| 6,604,666 | B1 * | 8/2003 | Pedicini et al. | 227/131 |
| 6,705,503 | B1 * | 3/2004 | Pedicini et al. | 227/131 |
| 6,783,045 | B2 * | 8/2004 | Shima et al. | 227/8 |
| 6,796,475 | B2 * | 9/2004 | Adams | 227/2 |
| 6,971,567 | B1 * | 12/2005 | Cannaliato et al. | 227/2 |
| 6,974,061 | B2 * | 12/2005 | Adams et al. | 227/2 |
| 6,983,871 | B2 * | 1/2006 | Shima et al. | 227/8 |
| 7,137,541 | B2 * | 11/2006 | Baskar et al. | 227/120 |

(Continued)

FOREIGN PATENT DOCUMENTS

| | | | |
|---|---|---|---|
| EP | 1 867 439 | | 12/2007 |
| JP | 2004-536542 | A | 12/2004 |
| WO | WO02/051591 | A1 | 7/2002 |

OTHER PUBLICATIONS

Japan Patent Office office action for patent application JP2008-171274 (Nov. 29, 2012).

*Primary Examiner* — Robert Long
(74) *Attorney, Agent, or Firm* — Kilpatrick Townsend & Stockton LLP

(57) ABSTRACT

A fastener driving tool has a housing, a nose portion, a magazine, a motor, a plunger, a drive mechanism, a trigger switch, a detection switch, an energizing switch, a failure detection circuit. The magazine is configured to store and supply a fastener to the nose portion. The motor is provided in the housing. The a plunger is provided in the housing to move between a top dead center and a bottom dead center. The plunger has a blade for impacting the fastener. The drive mechanism is configured to drive the plunger with power from the motor. The trigger switch is configured to drive the drive mechanism, and operated by a user. The detection switch is configured to be switched according to an arrangement of the drive mechanism. The energizing switch is configured to control power feed of the motor. The energizing switch is switched by the trigger switch and the detection switch. The failure detection circuit is configured to turn off the energizing switch, based on a condition of the detection switch prior to impacting the fastener.

5 Claims, 8 Drawing Sheets

(56) References Cited

U.S. PATENT DOCUMENTS

| | | | | |
|---|---|---|---|---|
| 7,285,877 | B2 * | 10/2007 | Gorti et al. | 307/326 |
| 7,464,846 | B2 * | 12/2008 | Shelton et al. | 227/175.1 |
| 7,467,739 | B2 * | 12/2008 | Fujisawa et al. | 227/10 |
| 7,469,811 | B2 * | 12/2008 | Shima et al. | 227/131 |
| 7,494,036 | B2 * | 2/2009 | Shima et al. | 227/131 |
| 7,646,157 | B2 * | 1/2010 | Cruise et al. | 318/161 |
| 7,652,442 | B2 * | 1/2010 | Miyazaki et al. | 318/432 |
| 7,832,610 | B2 * | 11/2010 | Tanimoto et al. | 227/132 |
| 8,186,553 | B2 * | 5/2012 | Tanimoto et al. | 227/132 |
| 8,251,271 | B2 * | 8/2012 | Nakano et al. | 227/8 |
| 8,393,512 | B2 * | 3/2013 | Tanimoto et al. | 227/146 |
| 2002/0185514 | A1 * | 12/2002 | Adams et al. | 227/2 |
| 2003/0149508 | A1 * | 8/2003 | Watanabe | 700/168 |
| 2004/0026475 | A1 * | 2/2004 | Ohmori | 227/10 |
| 2005/0217873 | A1 * | 10/2005 | Gross et al. | 173/1 |
| 2005/0218174 | A1 * | 10/2005 | Kenney et al. | 227/2 |
| 2006/0283909 | A1 * | 12/2006 | Shima et al. | 227/8 |
| 2007/0215664 | A1 * | 9/2007 | Moeller et al. | 227/2 |
| 2008/0017689 | A1 * | 1/2008 | Simonelli et al. | 227/132 |
| 2008/0047999 | A1 * | 2/2008 | Berry et al. | 227/7 |
| 2008/0257934 | A1 * | 10/2008 | Tanimoto et al. | 227/146 |
| 2009/0071998 | A1 * | 3/2009 | Nakano et al. | 227/8 |
| 2009/0179062 | A1 * | 7/2009 | Shima et al. | 227/2 |

* cited by examiner

FASTENER DRIVING TOOL

CROSS REFERENCE TO RELATED APPLICATIONS

This application claims priority from Japanese Patent Application No. 2008-171274 filed Jun. 30, 2008. The entire content of the priority application is incorporated herein by reference.

TECHNICAL FIELD

The present invention relates to a fastener driving tool, and more particularly, to an electrical fastener driving tool.

BACKGROUND OF THE INVENTION

A spring-driven nail gun that retracts a plunger against a resilient force of a spring and then releases the plunger for impacting a nail to a workpiece have been wellknown as an electric power tool. U.S. Pat. No. 3,589,588 discloses an electric power tool having a plunger which is retracted by a mechanism including a motor and decelerating gears in the tool, which reduces power required to retract the plunger. The tool includes a detecting switch that detects a release operation of the plunger. When the release operation is detected, the tool stops feed to the motor.

In the above tool, even when the detecting switch is breakdown, the tool is able to perform a normal operation to impact the nail. When this case happens, a user may miss this failure and keep using the tool, because the tool is able to impact the nail. This condition may lead to a risk that the motor may keep rotating after the impacting operation is over, and cause unintentional continuous impacting operations.

An object of the invention is to provide a fastener driving tool which ceases an impacting operation in case a detecting switch is breakdown.

BRIEF SUMMARY OF THE INVENTION

The present invention features a fastener driving tool having a housing, a nose portion, a magazine, a motor, a plunger, a drive mechanism, a trigger switch, a detection switch, an energizing switch, a failure detection circuit. The magazine is configured to store and supply a fastener to the nose portion. The motor is provided in the housing. The a plunger is provided in the housing to move between a top dead center and a bottom dead center. The plunger has a blade for impacting the fastener. The drive mechanism is configured to drive the plunger with power from the motor. The trigger switch is configured to drive the drive mechanism, and operated by a user. The detection switch is configured to be switched according to an arrangement of the drive mechanism. The energizing switch is configured to control power feed of the motor. The energizing switch is switched by the trigger switch and the detection switch. The failure detection circuit is configured to turn off the energizing switch, based on a condition of the detection switch prior to impacting the fastener.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE INVENTION

Figure 1:
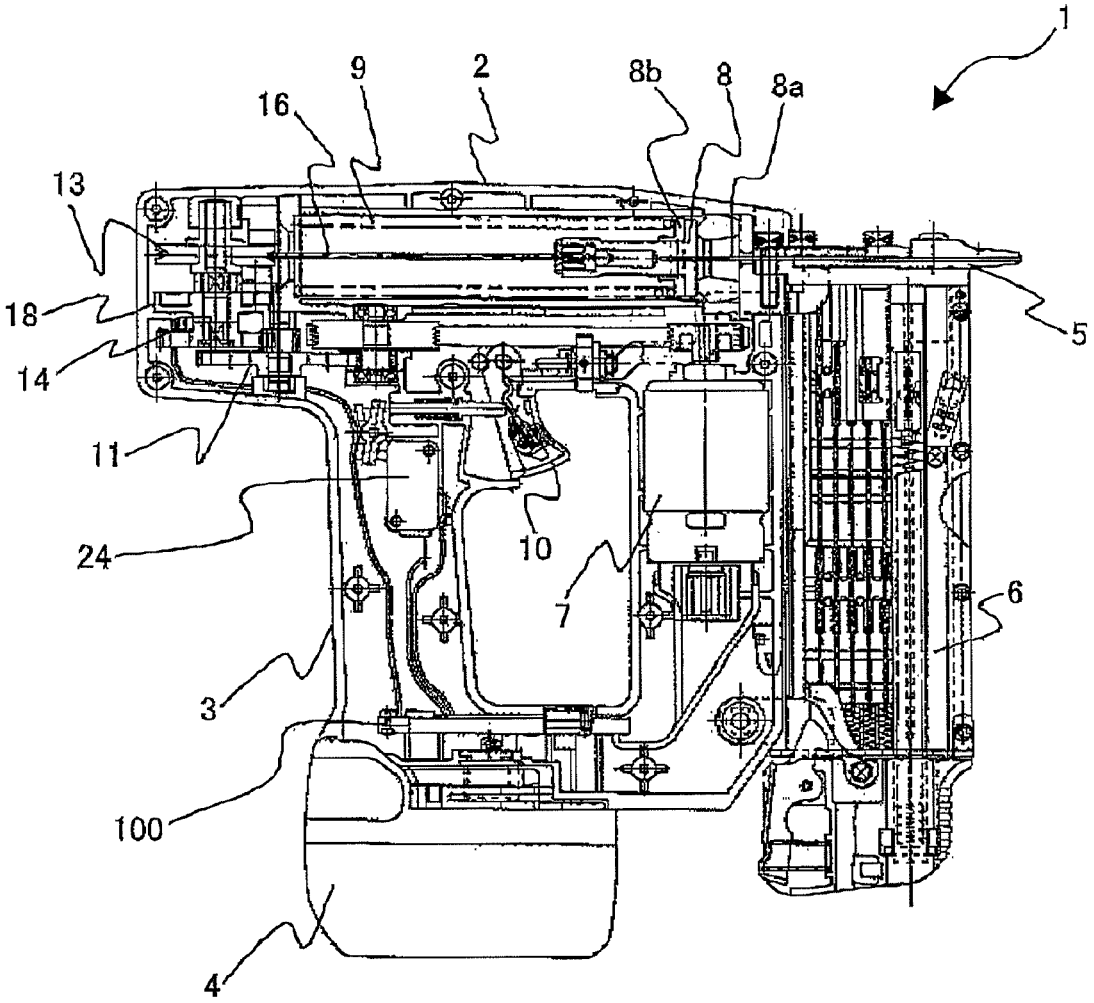
FIG. 1 is a partial section showing an electric nail gun according to an embodiment of the present invention, in which a plunger is at a bottom dead center.

An electrical fastener driving tool according to one embodiment of the present invention will be described with reference to FIGS. 1 through 6. FIG. 1 shows an electrically-operated type nail gun 1 that impacts a nail as a fastener into a workpiece such as a wood and a gypsum plaster board. Referring to FIGS. 1 through 3, the general structure of the nail gun 1 will be explained. The nail gun 1 mainly includes a housing 2, a handle 3, a battery 4, a nose portion 5, a magazine 6, a trigger 10, and a controller 100. Hereinafter, a direction in which a plunger 8 (described later) moves in the housing 2 to strike the nail will be described as a lateral direction.

The housing 2 includes the plunger 8, a spring 9, a motor 7, a decelerating mechanism 11, a gear 14, a guide plate 18, a drum 13, a wire 16, and a stop switch 25.

The plunger 8 is arranged so as to move between a top dead center and a bottom dead center in the housing 2. The plunger 8 has a blade 8*a*. The blade 8*a* has a tip end extending into a passage formed in the nose portion 5. A disk-shaped plunger plate 8*b* is arranged on the top dead center side of the plunger 8. The center of the plunger plate 8*b* is connected to the tip end of the blade 8*a* on the top dead center side. When the plunger 8 is positioned at the top dead center, the nail is placed in the passage in the nose portion 5. When the blade 8*b* is moved to the bottom dead center side, the nail is pushed out of the tip end of the nose portion 5 by the blade 8*a*, and then impacted in the workpiece.

The spring 9 is arranged between the plunger plate 8*b* and a left end of the housing 2 shown in FIG. 1. The motor 7 has a rotation shaft (not shown), and is rotated with electric power from the battery 4 to provide a torque to the decelerating mechanism 11. The decelerating mechanism 11 has the motor 7, a pulley (not shown) connected to the rotation shaft, gears, and a belt to generate a torque to an output shaft 19 described later (See FIGS. 2A to 2C). The decelerating mechanism 11 amplifies a torque of the motor 7, so the motor 7 used in the decelerating mechanism 11 can become compact.

The drum 13 is rotated with the torque generated by the motor 7 and supplied through the decelerating mechanism 11, interlocked with the operation of a compression release mechanism (a clutch mechanism) described later. The wire 16 is made with a plurality of metal rods wound and has some flexibility and strength. The wire 16 has a surface coated with a resin in order to avoid wearing due to contact with the drum 13.

The handle 3 extends from the housing 2 and is provided with the trigger 10 to control the operation of the motor 7. A trigger switch 24 is provided in the handle 3 to be operated interlocking with the trigger 10. The controller 100 is provided in the housing 2. The battery 4 is detachably attached to an end of the housing 2. The controller 100 feeds electric power from the battery 4 to the motor 7 by wiring (not shown) provided in the handle 3.

The magazine 6 is placed across the nose portion 5 and the top portion of the housing 2. The magazine 6 accommodates a bunch of a plurality of nails (not shown) to supply the nail to the passage in the nose portion 5. The length of the passage in the nose portion 5 is longer than the length of the nail, and provides an approach section to accelerate the nail until the nail becomes contact with the workpiece.

Figure 2A:
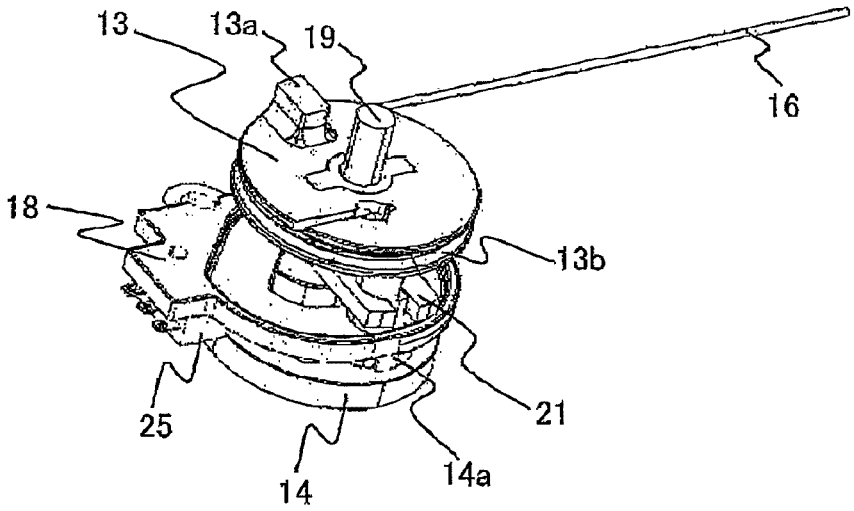
FIG. 2A is a perspective view showing a spring compression release mechanism.
Figure 2B:
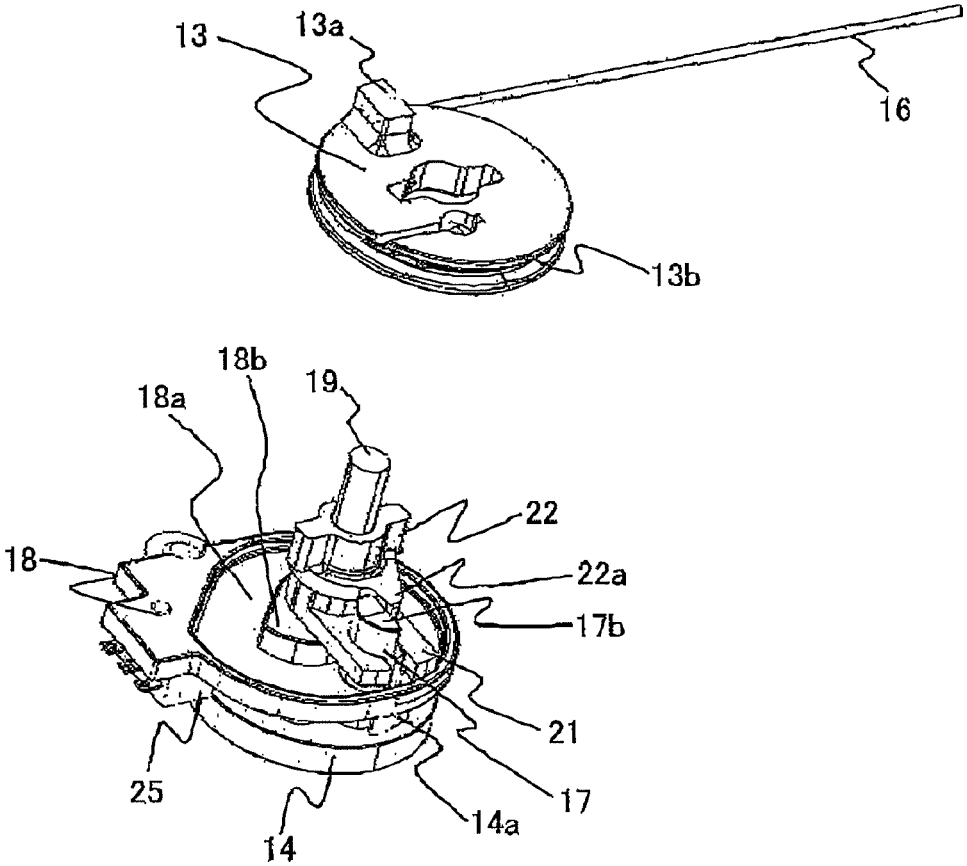
FIG. 2B is a partial exploded view showing the spring compression release mechanism of FIG. 2A.

The structure of the clutch mechanism as the compression release mechanism for the spring 9 will be described, referring to FIGS. 2A to 2C. The compression release mechanism for the spring 9 includes the decelerating mechanism 11, the output shaft 19 of the decelerating mechanism 11, the gear 14, the guide plate 18, a pin support plate 21, a drum hook 22, the drum 13, a power transmission pin 17, and the wire 16.

Figure 2C:
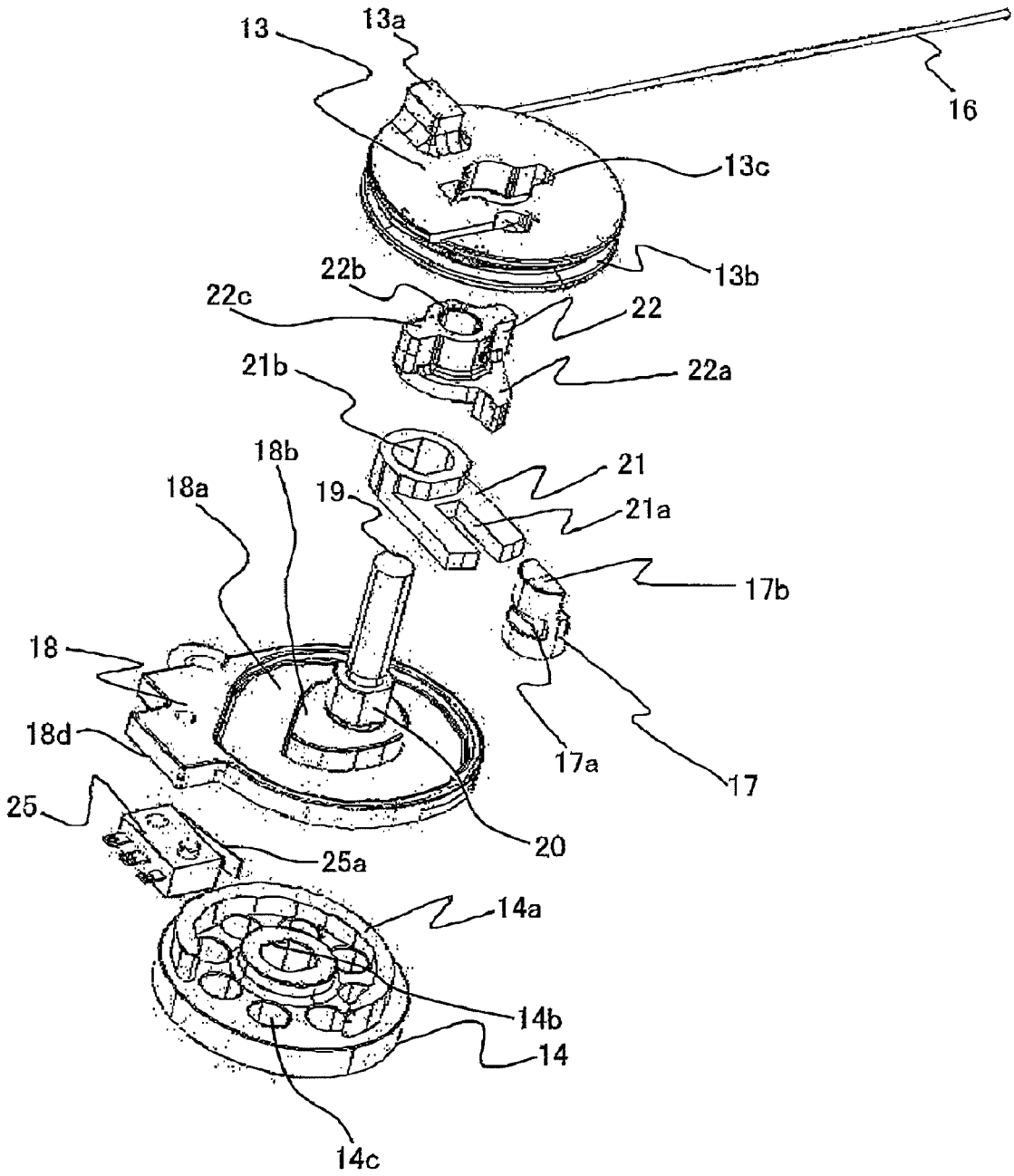
FIG. 2C is an exploded view showing the spring compression release mechanism of FIG. 2A.

As shown in FIG. 2C, the gear 14 has a disk shape and has a fitting hole 14*b* at the center. The fitting hole 14*b* had a width across flat. A plurality of through holes 14*c* are formed around the fitting hole 14*b*. An extending portion 14*a* is provided around the circumferential edge of an upper surface of the gear 14. The output shaft 19 has a width across flat portion (not shown) which is cut in the shape of a width across flat. The width across flat portion of the output shaft 19 is inserted and fitted in the fitting hole 14*b* of the gear 14, so that the gear 14 is fixed to the output shaft 19. The through holes 14*c* are formed in the gear 14 for weight and inertia reduction of the gear 14. The extending portion 14*a* is formed in order to turn on and off the stop switch 25 by the engagement or disengagement with the stop switch 25 described later.

The guide plate 18 is formed with a guide groove 18*a*, a guide projection 18*b*, a projection portion 18*d*, and a through hole (not shown). The through hole is formed at a center of the guide plate 18. The output shaft 19 are inserted through the through hole. The guide groove 18*a* is formed adjacent to the through hole. The guide projection 18*b* is formed around the through hole so as to have a portion which has a longer length from the through hole to the guide groove 18*a*. In detail, the guide projection 18*b* has a convex shape having a length of 5-15 mm in a radial direction from the center of the through hole. The projection portion 18*d* has a rectangular shape and is formed at the outer periphery of guide plate 18. A key 20 fixed to the output shaft 19 is provided on the upper surface of the guide projection 18*b*. The key 20 has a outer shape having a width across flat in a horizontal cross section. The key 20 is fitted in a through hole 21*b* of the pin support plate 21 described later.

The stop switch 25 has a open/close portion 25*a* having a rectangular shape. The stop switch 25 is turned on and off by opening and closing the open/close portion 25*a*, respectively. The stop switch 25 is fixed to the guide plate 18 in order to be placed between the outer upper surface of the gear 14 and the lower surface of the projection portion 18*b* of the guide plate 18. The length of the stop switch 25 in the direction of the output shaft 19 is substantially equal to the height of extending portion 14*a* of the gear 14. The open/close portion 25*a* is attached to the position in order that the engagement and disengagement with the extending portion 25*a* is switched according to the rotation of the gear 14.

The pin support plate 21 has a through hole 21*b* which is formed by forming out the width across flat hole in the body portion. An extending portion having a pin support slide portion 21*a* extends from the body portion. When the key 20 is inserted in and engaged with the through hole 21*b*, the pin support plate 21 is fixed to the output shaft 19.

A power transmission pin 17 includes a guide groove contact portion 17*a* and a pin contact portion 17*b*. The guide groove contact portion 17*a* is able to be engaged in the guide groove 18*a*. Accordingly, the moving direction and the moving distance of the power transmission pin 17 is controlled by the shape of the guide groove 18*a*. The pin contact portion 17*b* has the same height as that of a hook portion 22*a* of a drum hook 22, when being assembled with the compression release mechanism. The right side surface of the pin contact portion 17*b* of the power transmission pin 17 is slid ably supported by the pin support slide portion 21*a*.

The above structure enables the pin support plate 21 and the power transmission pin 17 to rotate together in synchronization with the rotation of the output shaft 19.

The drum hook 22 includes a cylindrical main portion 22*c*, a bearing 22*b*, and a hook portion 22*a* extending from the side surface of the main portion 22*c*. The bearing 22*b* is positioned so as to contact with the inner surface of the main portion 22*c*,. The output shaft 19 is inserted in he drum hook 22 through the bearing 22*b*, so that the output shaft 19 and the drum hook 22 are not always rotated in synchronization with each other. The hook portion 22*a* extends from the main portion 22*c* in a direction perpendicular to the output shaft 19 and is able to contact with the pin contact portion 17*b* of the power transmission pin 17. Accordingly, the power transmission pin 17 always rotates in synchronization with the pin support plate 21. The drum hook 22 rotates in synchronization with the pin support plate 21 and the power transmission pin 17, only when the pin contact portion 17*b* of the power transmission pin 17 becomes contact with the hook portion 22*a*.

The drum 13 has a disk shape. The drum 13 has a through hole 13*c* at the center thereof, and the main portion 22*c* of the drum hook 22 is pressed into the through hole 13*c*,. Accordingly, the drum 13 and the drum hook 22 rotate in synchronization with each other. A damper collision portion 13*a* projects from the drum 13 in the axial direction of the output shaft 19.

The wire 16 is able to be wound around the lateral surface of the drum 13 and connects the drum 13 to the plunger 98 (see FIG. 1). The wire 16 is wound or rewound around the lateral surface of the drum 13 to move the plunger 8.

The operation of the spring compression release mechanism will be described, referring to FIGS. 3A to 3D. The plunger 8 is positioned at the bottom dead center at an initial stage of the impacting operation by nail gun 1. When a user pulls the trigger 10, electric power is supplied from the battery 4 to the motor 7 by the trigger switch 24 and the controller 100 to rotate the motor 7. The torque generated by the motor 7 is transferred to the pin support plate 21 and the power transmission pin 17 through the decelerating mechanism 11 and the output shaft 19.

Figure 3A:
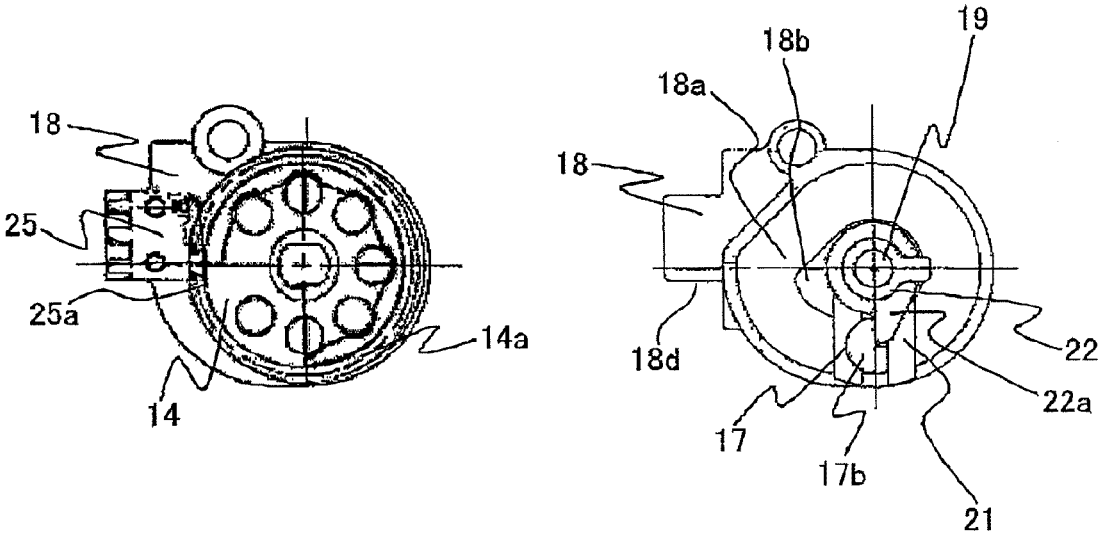
FIGS. 3A-3D are perspective views showing the the spring compression release mechanism with a drum being removed.

FIG. 3A shows the initial condition of the spring compression release mechanism. When the pin contact portion 17*b* is contact with the hook portion 22*a*, the power transmission pin 17 and the drum hook 22 are engaged with each other to move together. Therefore, the pin support plate 21 is rotated, and the drum hook 22 and the drum 13 are rotated, simultaneously. The open/close portion 25*a* of the stop switch 25 is positioned at a 90° angle in a clockwise direction with respect to the contact surface between the pin contact portion 17*b* and the hook portion 22*a* which are positioned at the initial condition. In the initial condition, the extending portion 14*a* of the gear 14 is positioned across the angular range from the above contact surface to 270° angle in a counterclockwise direction.

At this time, the open/close portion 25*a* of the stop switch 25 is engaged with the extending portion 14*a* of the gear 14 to be closed. The stop switch 25 turns on immediately after the trigger switch 24 is turned on.

Figure 3B:
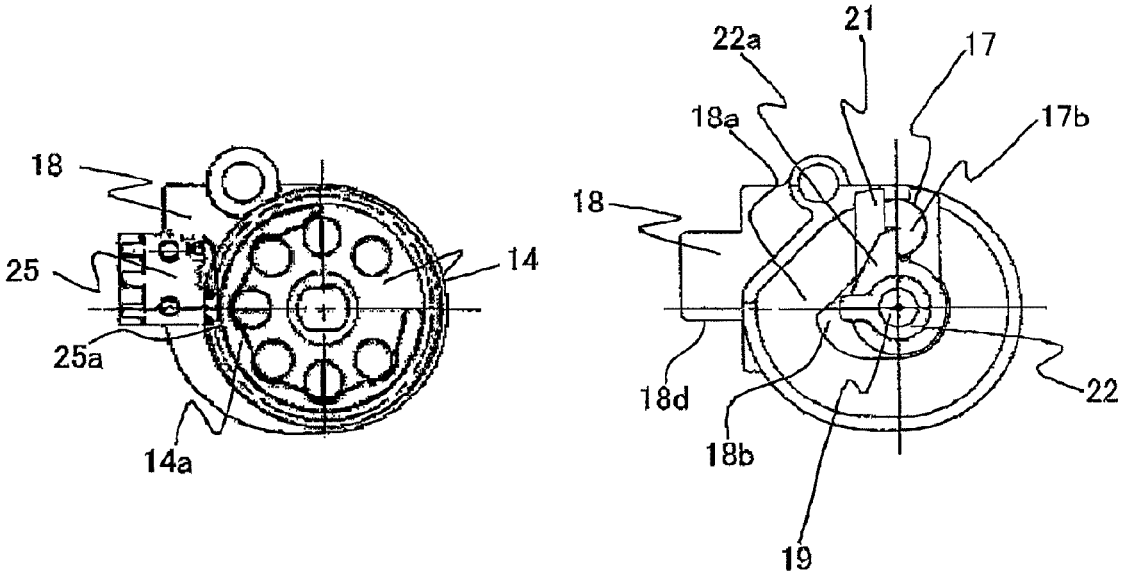

FIG. 3B shows the pin support plate 21 which has been rotated by 180° angle from the condition shown in FIG. 3A in the counterclockwise direction. The drum 13 is rotated by 180° in synchronization with the rotation of the pin support plate 21 to entangle one end of the wire 16 to a drum concave portion 13*b*. When the wire 16 is entangled, the plunger 8 connected to the other end of the wire 16 is pulled to move toward the top dead center. Simultaneously, the plunger plate 8*b* attached to the end of the plunger 8 compresses the spring 9. At this time, the stop switch 25 is maintained turned on.

Figure 3C:
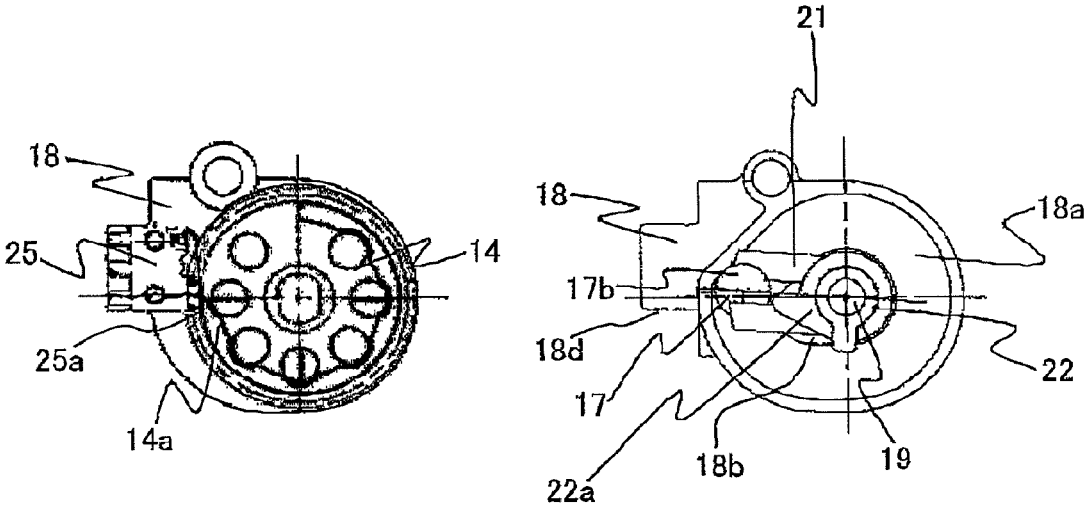

As the pin support plate 21 is rotated from the condition shown in FIG. 3B to the condition shown in FIG. 3C, the end of the power transmission pin 17 becomes contact with the guide projection 18*b* of the guide groove 18*a*. The guide projection 18*b* has the convex shape having a length of 5-15 mm from the rotation axis in the radial direction. As the pin support plate 21 rotates, the power transmission pin 17 moves outward along the pin support slide portion 21*a* in the radial direction and along the shape of the guide projection 18*b*. During this time, the open/close portion 25*a* of the stop switch 25 maintains the engagement with the extending portion 14*a* and is turned on.

When the pin support plate 21 i.e., the drum 14 is rotated from the condition shown in FIG. 3A by 270° angle to the condition shown in FIG. 3C, the plunger 8 is moved to the top dead center, and the spring 9 becomes compressed most. The nail at the front end in the magazine 6 is pressed by a feeding member (not shown) to be loaded in the ejection passage. Simultaneously, the power transmission pin 17 is moved outward in the radial direction by 5-15 mm, and the power transmission pin 17 is disengaged from the hook portion 22*a*. At this time, the open/close portion 25*a* of the stop switch 25 reaches the edge of the extending portion 14*a*. However, the stop switch 25 is still turned on.

Figure 3D:
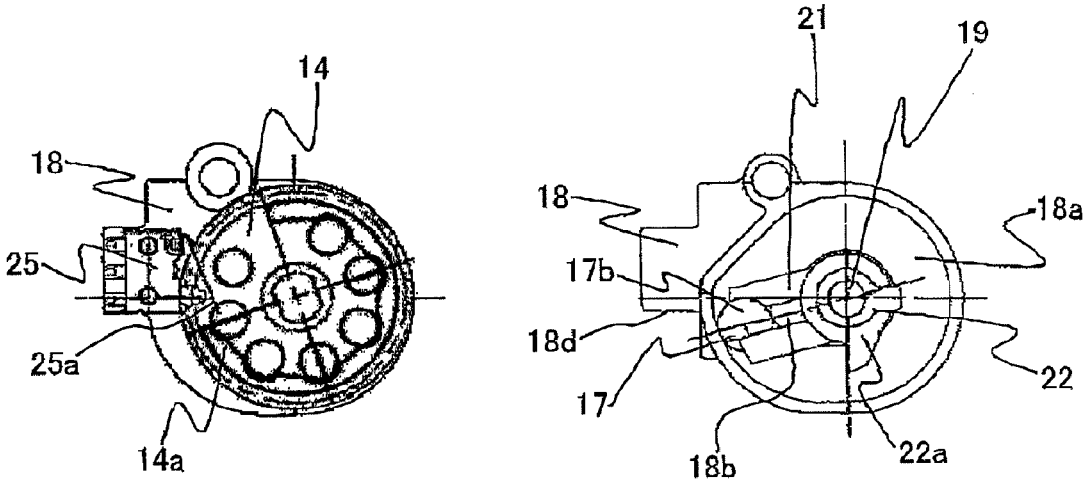

When the power transmission pin 17 is disengaged from the hook portion 22*a*, the compressed spring 9 is released and the plunger 8 is moved toward the bottom dead center. When the plunger 8 is moved to the bottom dead center, the drum 13 and the drum hook 22 which have been drawn by the wire 16 start counter rotating (FIG. 3D). On the other hand, the gear 14 further rotates together with the output shaft 19 in the counterclockwise direction, as shown in FIG. 3D. Accordingly, the open/close portion 25*a* of the stop switch 25 reaches the position where the extending portion 14*a* is not formed, and is disengaged from the extending portion 14*a*, the open/close portion 25*a* is turned off.

When the plunger 8 reaches the bottom dead center by the resilience force of the compressed spring 9, the nail placed in the ejection passage in the nose portion 5 is pushed by the blade 8*a* out of the tip end of the nose portion 5, and then impacted into the workpiece. After the nail is impacted, turning off of the stop switch 25 in the above described manner causes the controller 100 to suspend the feeding power to the motor 7 from the battery 4, thereby stopping the rotation of the motor 7. When the drum 13 returns to the initial condition, the damper collision portion 13*a* becomes engaged with the drum damper (not shown) fixed to the housing 2, and the drum 13 and the drum hook 22 are fixed to the initial position. At this time, the stop switch 25 becomes engaged with the extending portion 14*a* again, so that the stop switch 25 is turned on.

When the operation of the stop switch 25 is explained in brief, the open/close portion 25*b* is turned on by the extending portion 14*a* of the gear 14 in the initial condition. In other words, the stop switch 25 is turned on immediately after the trigger switch 25 is turned on. When the drum 13 is rotated by 270° angle with the stop switch 25, maintaining the on condition, the power transmission pin 17 is disengaged from the hook portion 22*a*, and the drum 13 starts reverse-rotation. These operation causes the impacting operation. When the gear 14 is further rotated, the stop switch 25 is disengaged from the extending portion 14*a* of the gear 14, and the stop switch 25 is turned off. Due to the inertia of rotation, the gear 14 is further rotated, is back to nearly 0° angle, and returns to the condition shown in FIG. 3A.

Figure 4:
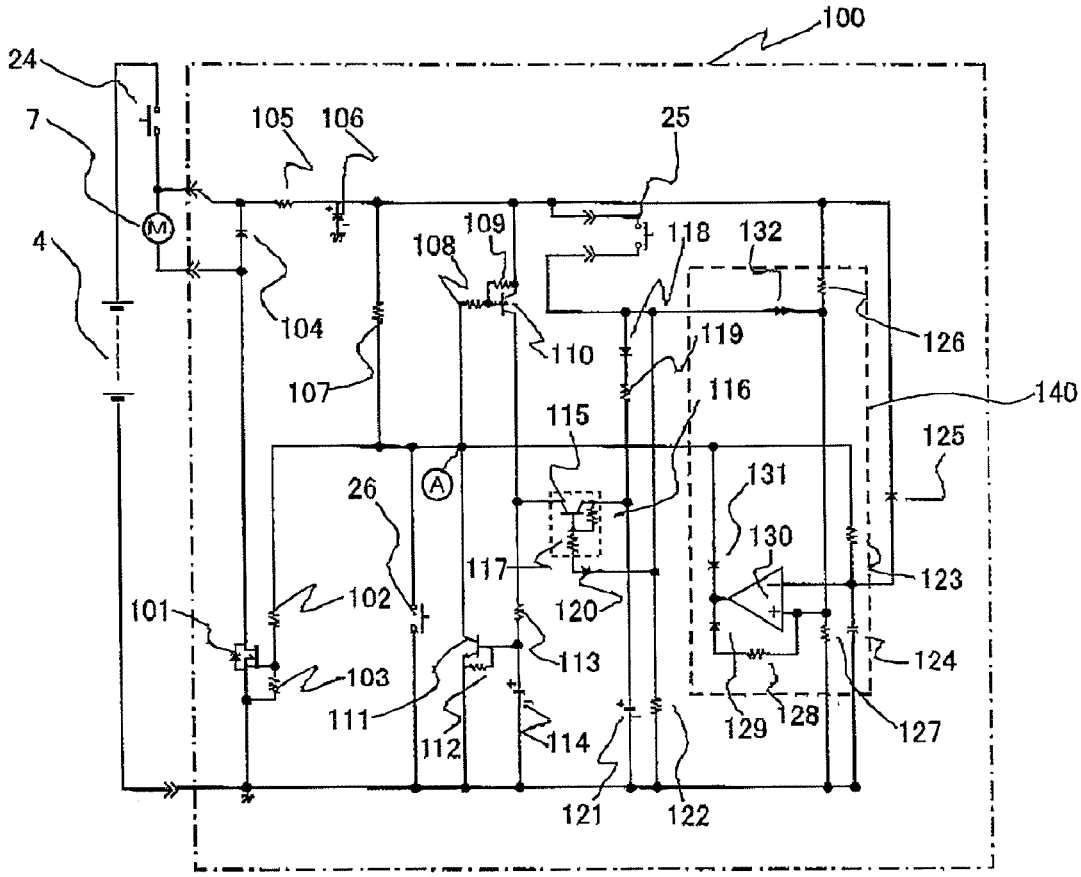
FIG. 4 is a circuit diagram showing a controller according to the present invention.

The configuration of the controller 100 will be described referring to the block diagram shown in FIG. 4. The controller 100 includes a field-effect transistor (FET) 101 as an energizing switch, a PNP transistor 110, an NPN transistor 111, a PNP transistor 115, a capacitor 114, a capacitor 121, the stop switch 25, and a failure detection circuit 140. In this embodiment, an N-channel FET is used as the FET 101.

The FET 101 is electrically connected to the battery 4, the trigger switch 24, and the motor 7 in series. A resistor 103 is connected between the gate and the source of the FET 101. A resistor 102 is connected to the gate of the FET 101. The resistor 102 is connected to a ground through a remaining nail amount detection switch 26. The remaining nail amount detection switch 26 detects the remaining amount of the nails in the magazine 6. The remaining nail amount detection switch 26 is turned off if the remaining amount of nails is more than a predetermined amount. The remaining nail amount detection switch 26 is turned on if the remaining amount of nails is less than or equal to the predetermined amount.

A diode 104 is connected between the two terminals of the motor 7 to prevent generation of a fly back voltage. A smoothing circuit includes a resistor 105 and a capacitor 106, and is connected to the higher potential terminal of the motor 7. The output terminal of the smoothing circuit is connected to the gate of the FET 101 through resistors 107 and 102. With this configuration, when the trigger switch 24 is turned on, a voltage Vs smoothed by the smoothing circuit is applied to the gate of the FET 101, which turns on the FET 101 to supply a current flow to the motor 7.

The output terminal of the smoothing circuit is connected to the emitter of the PNP transistor 110. A resistor 109 is connected between the base and the emitter of the PNP transistor 110. Further, the base of the PNP transistor 110 is connected to the collector of the NPN transistor 111 through a resistor 108. The collector of the PNP transistor 110 is connected to the base of the NPN transistor 111 through a resistor 113. A resistor 112 is connected to the capacitor 114 in parallel. The parallel-connected resistor 112 and capacitor 114 is connected between the base and the emitter of the NPN transistor 111. The emitter of the NPN transistor 111 is further connected to the negative terminal of the battery 4. The collector of the NPN transistor 111 is connected to the gate of the FET 101 through the resistor 102. The node between the resistor 108 and the collector of the NPN transistor 111 is designated as a node A hereinafter.

The output terminal of the smoothing circuit is connected to one end of the stop switch 25. The other end of the stop switch 25 is the negative terminal of the battery 4 through a resistor 122. A diode 118 for backflow prevention, a resistor 119, and the capacitor 121 are connected in series in this order between the other end of the stop switch 25 and the negative terminal of the battery 4. The output terminal of the resistor 119 is further connected to the emitter of the PNP transistor 115. A resistor 116 is connected between the base and the emitter of the PNP transistor 115. The base of the PNP transistor 115 is further connected to the other end of the stop switch 25 through a resistor 117 and a diode 120. The collector of the PNP transistor 115 is connected to the collector of the PNP transistor 110.

The failure detection circuit 140 includes an operational amplifier (Op-Amp) 130, resistors 123, 126, 127, and 128, diodes 125, 129, and 131, and a capacitor 124. The resistors 126 and 127 are connected in series between the output terminal of the smoothing circuit and the negative terminal of the battery 4. The voltage obtained by dividing the smoothed voltage Vs by the resistors 126 and 127 is applied to the non-inverting input terminal of the Op-amp 130. The non-inverting input terminal of the Op-amp 130 is connected to the other end of the stop switch 25 through a diode 132. The non-inverting input terminal of the Op-amp 130 is connected to the output terminal thereof through the resistor 128 and the diode 129. The resistor 128 and the diode 129 constitute a Schmitt trigger circuit performing a positive feedback. The inverting input terminal is connected to the gate resistor 102 of the FET 101 through the resistor 123, and connected to the ground through the capacitor 124, so that the capacitor 124 is charged through the resistor 123. The inverting input terminal is connected to the output terminal of the smoothing circuit through the diode 125. The output terminal of the Op-amp 130 is connected to the gate resistor 102 through the diode 131. It is noted that the smoothed voltage Vs is applied to the Op-amp 130 as a power supply to the Op-amp 130.

Figure 5:
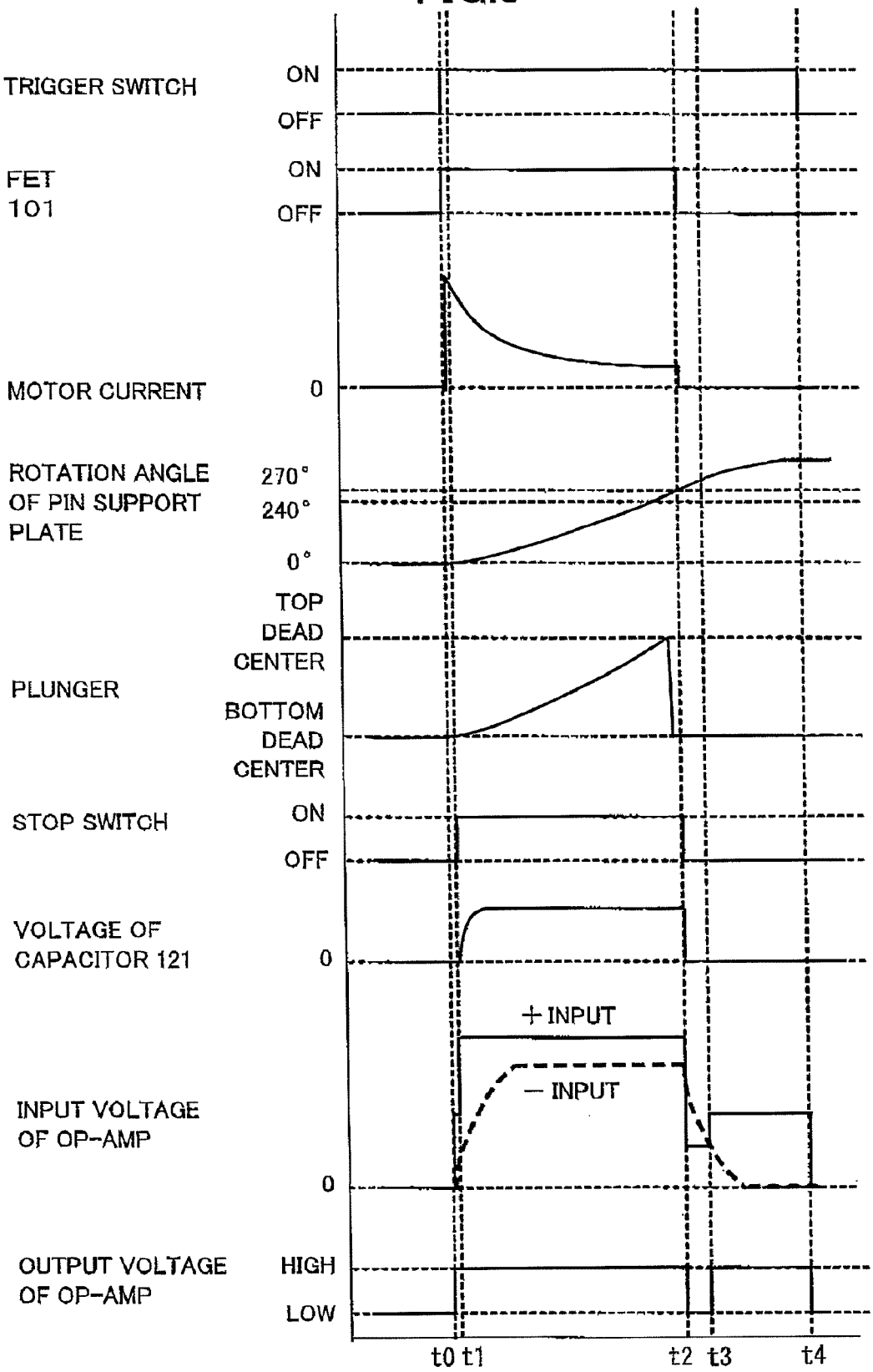
FIG. 5 is a timing chart of the controller during a normal operation.

The operation of the controller 100 will be described referring to FIG. 5. FIG. 5 shows time charts of the controller 100 under a normal operation. As shown in FIG. 5, when the trigger switch 25 is turned on at t=t0, the smoothed voltage Vs is applied from the smoothing circuit to the gate of the FET 101 to turn on the FET 101, so that a current flow starts flowing to the motor 7. The motor 7 then starts rotating, and the pin support plate 21 and the drum 13 also start rotating. As described above, the open/close portion 25*a* of the stop switch 25 is turned on at t=t1, because of becoming engaged with the extending portion 14*a* of the gear 14. In this embodiment, the resistor 103 has a sufficient larger resistance than the resistances of the resistors 108 and 109 (for example, approximate 10 times) in order to prevent the PNP transistor 110 from turning on immediately after the trigger switch 24 is turned on.

When the stop switch 25 is turned on immediately after the trigger switch 24 is turned on, the charging the capacitor 121 starts through the diode 118 and the resistor 119. The stop switch 25 is maintained on while the rotation angle of the drum 13 stays within the range from 0° to 270° angles. When the stop switch 25 is maintained on, the emitter potential of the PNP transistor 115 is lower than the cathode potential of the diode 120. Under this condition, the potential difference to turn on the PNP transistor 115 does not appear between the base and the emitter of the PNP transistor 115. Accordingly, the PNP transistor 115 is maintained off.

On the other hand, when the FET 101 is turned on, the smoothed voltage Vs is divided by the resistors 126 and 127. The resultant voltage appearing across the resistor 127 is applied to the non-inverting input terminal of the Op-amp 130 at t=t0.

One example of the resistances of the resistors 126 to 128 will be described. The input voltage to the non-inverting input terminal is set to be approximately a half of the smoothed voltage, when the smoothed voltage is divided by the resistors 126 and 127 to the input voltage. This input voltage is obtained if the resistances of the resistors 126 and 127 are set identical.

When the stop switch 25 is turned on at t=t1, the smoothed voltage Vs is applied to the non-inverting input terminal of the Op-amp 130 through the stop switch 25 and the diode 132. On the other hand, when the trigger switch 24 is turned on, the smoothed voltage Vs is applied to the capacitor 124 through the resistors 107 and 123 to charge the capacitor 124. The voltage across the capacitor 124 is applied to the inverting input terminal of the Op-amp 130. The input voltage to the inverting input terminal is always lower than the smoothed voltage Vs, though the capacitor 124 is charged. As a result, a High output appears at the output terminal of the Op-amp 130. This High output is interrupted by the diode 131.

When the rotation angle of the drum 13 becomes 270° angle (FIG. 3C), the contact of the pin contact portion 17*b* and the hook portion 22*a* is released, so that the reverse rotation of the drum 13 starts with the resilient force of the spring 9. At this time, the plunger 8 is moved to the bottom dead center. The gear 14 is further rotated in the clockwise direction, and the engagement between the open/close portion 25*a* and the extending portion 14*a* is released. Accordingly, the stop switch 25 is turned off at t=t2.

When the stop switch 25 is turned off, the input voltage at the non-inverting input terminal of the Op-amp 130 becomes the voltage appearing across the resistor 127 which is obtained by dividing the smoothed voltage Vs by the resistors 126 and 127. At this time, the output of the Op-amp 130 becomes Low, because the input voltage at the non-inverting input terminal becomes lower than the input voltage at the inverting input terminal. Simultaneously, the current flow flows through the resistor 128 by the diode 129, and the input voltage at the non-inverting input terminal further drops. The Low output of the Op-amp 130 causes the potential of the node A to become O volt, which turns off the FET 101 and the current flow ceases flowing to the motor 7. As described above, when the stop switch 25 is turned off, the drive of the motor 7 is ceased at t=t2.

At t=t2, in other words, when the potential of the node A becomes O volt with the output of the Op-amp 130, both of the PNP transistor 110 and the NPN transistor 111 are turned on, as described later. And, the potential of the node A is maintained 0 volt. When the output of the Op-amp 130 is changed to Low, the current flow starts flowing through the resistor 128 by the diode 129. Therefore, the input voltage at the non-inverting terminal drop to the voltage depending on the resistances of the resistors 126, 127, and 128 at t=t2. The capacitor 124 is discharged through the resistor 123, so that the voltage at the inverting input terminal gradually drops, and becomes lower than the voltage at the non-inverting input terminal at t=t3. At this time, the voltage at the non-inverting input terminal becomes the voltage divided by the resistors 126 and 127 and appearing across the resistor 127. The output voltage of the Op-amp 130 is changed to High. However, the High output of the Op-amp 130 is interrupted by the diode 131. Further, the potential at the node A is maintained 0 volt, because the transistors 110 and 111 are maintained to be turned on until the trigger switch 24 is turned off.

When the stop switch 25 is turned off, the base of the PNP transistor 115 is connected to the ground through the resistor 117, the diode 120, and the resistor 122, and the emitter of the PNP transistor 115 is connected to the charged capacitor 121. Then, a potential difference occurs between the base and the emitter of the PNP transistor 115. Accordingly, the PNP transistor 115 is turned on, and the electric charge in the capacitor 121 is flown to the capacitor 114 through the resistor 1 13.

As the capacitor 114 is charged, the potential at the base of the NPN transistor 111 rises to turn on the NPN transistor 111. When the NPN transistor 111 is turned on, the potential at the node A becomes the ground, and the potential at the gate of the FET 101 becomes the ground. Therefore, the FET 101 is turned off and the current flow to the motor 7 is ceased.

When the NPN transistor 111 is turned on, the base of the PNP transistor 110 is also connected to the ground level through the resistor 108, and the transistor 110 is turned on. As long as the trigger switch 24 is maintained closed, the smoothed voltage is applied to the base of the NPN transistor 111, which maintains the NPN transistor 111 turned on. Accordingly, once the NPN transistor 111 is turned on, the NPN transistor 111 is maintained on, i.e., the FET 101 is maintained off, even if all electric charge stored in the capacitor 121 is discharged. It is preferable that the capacitance of the capacitor 114 is set to be larger than the capacitance of the capacitor 121.

When the trigger switch 24 is turned off, the PNP transistor 110 is turned off, and the off condition of the FET 101 can be released. And then, if the trigger switch 24 is again turned on, the FET 101 is turned on to energize the motor 7.

The above operation of the controller 100 enables the nail gun 1 to impact the nail. The single impact of the nail has been implemented, if the FET 101 is turned off after finishing the single operation to impact the nail.

Figure 6:
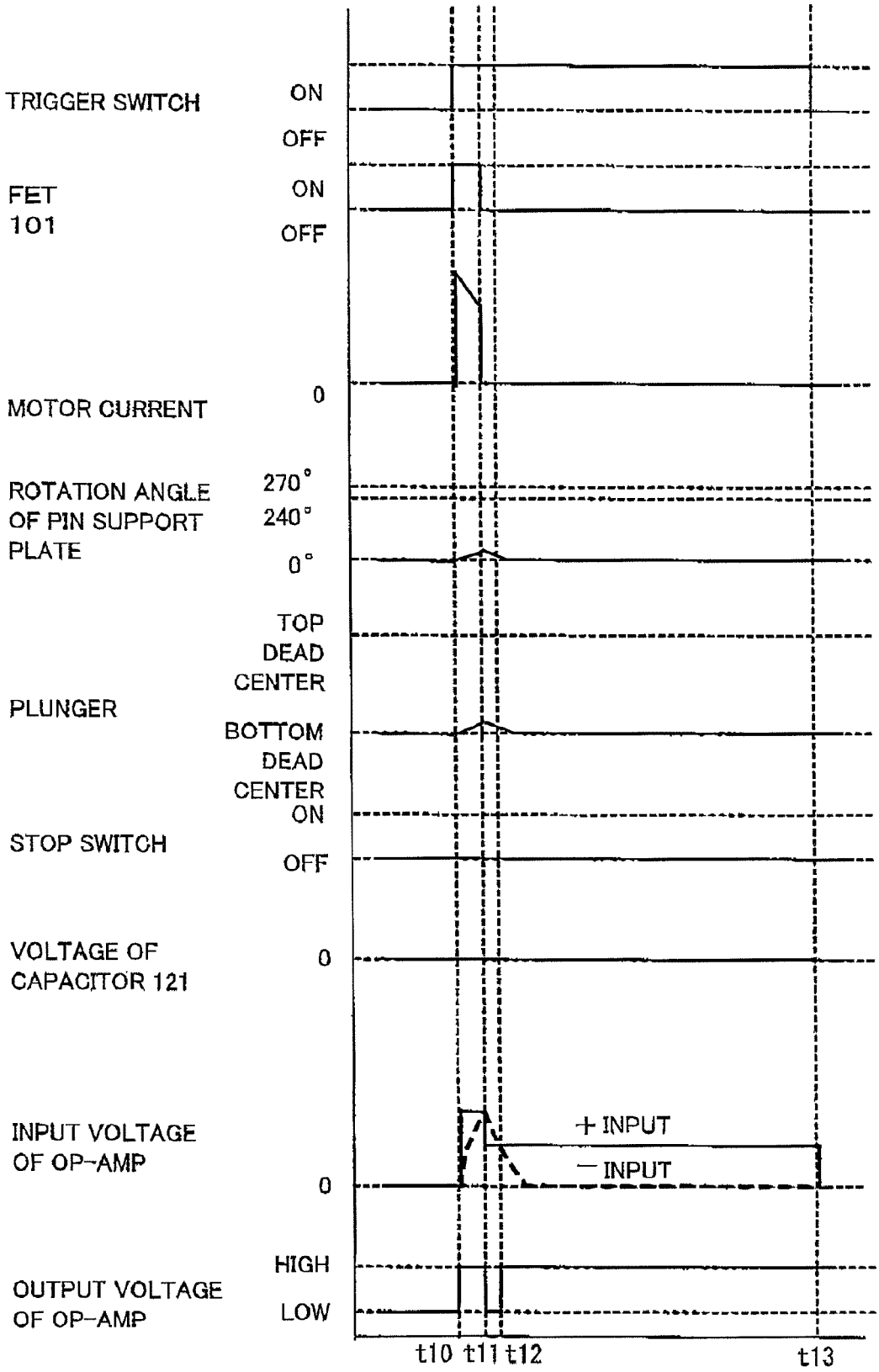
FIG. 6 is a timing chart of the controller when a stop switch is breakdown.

The operation of the controller 100 will be described referring to FIGS. 4 and 6, when the stop switch 25 is disabled due to a failure. It happens that the stop switch 25 may break down, such as that the stop switch 25 cannot be pressed down due to a mechanical trouble, or the stop switch 25 cannot be switched due to a mechanical or electric trouble. If the failure happens, the controller 100 prevents impacting the nail as follows.

When the trigger switch 24 is turned on at t=t10, the FET 101 is turned on and a current flow stats flowing to the motor 7. Simultaneously, the pin support plate 21 and the plunger 8 start moving. If the stop switch 25 is not switched to be closed due to a failure, the input voltage at the non-inverting input terminal of the Op-amp 130 is equal to the voltage appearing across the resistor 127 which is obtained by dividing the smoothed voltage by the resistors 126 and 127. The voltage at the inverting input terminal of the Op-amp 130 is equal to the voltage across the capacitor 124 which is charged by the smoothed voltage Vs through the resistors 107 and 123. As shown in FIG. 6, the voltage across the capacitor 124 at t=t10 is 0 volt, and the voltage at the non-inverting input terminal is larger than the voltage at the inverting input terminal, so that the output of the Op-amp 130 is the High output. At this time, the output voltage from the Op-amp 130 is interrupted by the diodes 129 and 131.

Sequentially, the voltage appearing across the capacitor 124 gradually increases due to the charging, and then the voltage at the inverting input terminal becomes greater than the voltage at the non-inverting input terminal at t=t11. At this time, the output of the Op-amp 130 becomes Low output. Simultaneously, a current flow flows to the resistor 128 by the diode 129, so that the input voltage at the non-inverting input terminal drops at t=t11. For example, the resistance of the positive feedback resistor 128 is set to be one third of the smoothed voltage Vs which is obtained by dividing the smoothed voltage Vs by the resistance of the resistor 126 and the parallel-connected combined resistance of the resistors 127 and 128.

The Low output of the Op-amp 130 causes the voltage of the node A to be maintained 0 volt by the diode 131, so that the gate voltage of the FET 101 drops to 0 volt by the resistor 102, the FET 101 is turned off to interrupt the power supply to the motor 7. It is preferable that the time period from t0 to t11 is set longer than the time period from t0 to t1 because of the combination of the proper resistance of the resistor 123 and the proper capacitance of the capacitor 124. In this embodiment, the time period from t0 to t11 is set a sufficient short time such as 30 ms in order to cease the impact operation.

When the voltage at the node A becomes 0 volt, the PNP transistor 110 and the NPN transistor 111 are maintained to be turned on, maintaining the voltage at the node A 0 volt, as described above. And, as the capacitor 124 is discharged through the resistor 123, the input voltage at the inverting input terminal gradually drops, and becomes lower than the input voltage at the non-inverting input terminal at t=t12. At this time, the input voltage at the non-inverting input terminal is the voltage which is obtained by divided the smoothed voltage Vs by the resistors 126 and 127, and the output voltage of the Op-amp 130 becomes High. However, this output voltage of the Op-amp 130 is blocked by the diode 131. Further, the voltage at the node A is maintained 0 volt, because the transistors 110 and 111 are maintained on until the trigger switch 24 is turned off.

As described above, in this embodiment, the stop switch 25 is turned on immediately after the trigger switch 24 is turned on, and turned off after the impacting action is over. When a mechanical failure prevents the stop switch 25 from being turned on, the output of the Op-amp 130 becomes a Low, the gate terminal voltage of the FET 101 becomes 0 volt to turn off the FET 101. In other words, the failure detection circuit 140 monitors whether the stop switch 25 is switched or not prior to impacting the nail. If the stop switch 25 is not switched, the controller 100 causes the FET to turn off for stopping feed to the motor 7. Accordingly, the impacting action is prevented when the stop switch 25 is breakdown.

In this embodiment, the plunger 8 is positioned at the bottom dead center in the initial condition. In the nail gun having the plunger 8 which is positioned between the top dead center and the bottom top center, an amount of time period from the operation of the trigger to the beginning of the impact action may change due to the repeated operations of the trigger switch. In this embodiment, the position of the plunger 8 does not change in the initial condition, so that the time amount until the start of the impacting operation substantially does not change. Accordingly, if the stop switch 25 has not been switched during a predetermined time period after the trigger switch 24 is turned on, the FET is turned off to interrupt the impacting operation. If the time t=t11 is set appropriately, preferably, t=t11 is set shorter than the time period required to prepare for the impacting nail, the impacting action is readily prohibited when the stop switch 25 is breakdown.

As described above, in the electric nail gun according to the present invention, the impacting operation of the nail gun is prohibited without providing a specific mechanism prior to performing the impacting nail according to the operation of the trigger switch if the stop switch is breakdown. In other words, the nail gun which is easy to operate, reliable, and at low cost can be provided.

It is understood that the foregoing description and accompanying drawings set forth the embodiments of the invention at the present time. Various modifications, additions and alternative designs will, of course, become apparent to those skilled in the art in light of the foregoing teachings without departing from the spirit and scope of the disclosed invention. For example, the circuit diagram of the controller 100 is not limited to the above embodiment but any other circuit which has the same operation and advantages.

In another embodiment, a micro computer having the same functions can be used instead of the failure detection circuit 140.

What is claimed is:

1. A fastener driving tool comprising:

a housing;

a motor provided in the housing to rotate a drum;

a plunger provided in the housing and configured to move up and down between a top dead center and a bottom dead center, the plunger having a blade for impacting a fastener;

a spring that urges the plunger downwards and is capable of being compressed upwards;

a wire member connected to the plunger and wound around the drum to move the plunger to the top dead center when the drum is driven by the motor;

an energizing switch connected between a power source and the motor to control a power supply to the motor;

a trigger switch that is operated by a user and is configured to turn on the energizing switch when the trigger switch is turned on;

a detection switch configured to turn on after the trigger switch is turned on, and to maintain the ON state during a time period that the plunger reaches the top dead center and then returns to the bottom dead center;

a control unit configured to supply electric power to the motor starting from when the trigger switch is turned on until the detection switch is turned off; and a failure detection circuit configured to stop the electric power supply to the motor when the detection switch is not turned on after the trigger switch is turned on.

2. A fastener driving tool, comprising:

a housing;

a motor provided in the housing to drive a rotatable member;

a plunger provided in the housing and configured to move up and down between an top dead center and bottom dead center, the plunger having a blade for impacting the fastener;

an elastic member that urges the plunger downwards and is capable of being compressed upwards;

a connecting member coupled between the plunger and the rotatable member to move the plunger to the top dead center when the rotatable member is driven by the motor;

an energizing switch connected between a power source and the motor to control a power supply to the motor;

a trigger switch that is operated by a user and is configured to turn on the energizing switch when the trigger switch is turned on;

a detection switch configured to turn on after the trigger switch is turned on, and to maintain the ON state during a time period that the plunger reaches the top dead center and then returns to the bottom dead center;

a control unit configured to supply electric power to the motor starting from when the trigger switch is turned on until the detection switch is turned off; and a failure detection circuit configured to stop the electric power supply to the motor when the detection switch is not turned on after the trigger switch is turned on.

3. The fastener driving tool as claimed in claim 2, wherein the energizing switch is turned off when the detection switch is not turned off a predetermined time period after the trigger switch is turned on.

4. A fastener driving tool, comprising:

a housing;

a motor provided in the housing to rotate a drum;

a plunger provided in the housing and configured to move up and down between a top dead center and bottom dead center, the plunger having a blade for impacting the fastener;

a spring that urges the plunger downwards and is capable of being compressed upwards;

a wire member connected to the plunger and wound around the drum to move the plunger to the top dead center when the drum is driven by the motor;

an energizing switch connected between a power source and the motor to control a power supply to the motor;

a trigger switch that is operated by a user and is configured to turn on the energizing switch when the trigger switch is turned on;

a control unit configured to supply electric power to the motor;

a detection switch configured to detect a rotational position of the drum, the detection switch turning on after the plunger starts to move to the top dead center, and maintaining the ON state at least until the plunger reaches a predetermined position near the top dead center; and a failure detection circuit configured to detect a failure situation when the detection switch is not turned on after the plunger starts to move to the top dead center and to stop supplying the electric power to the motor.

5. A fastener driving tool, comprising:

a housing;

a motor provided in the housing to drive a rotatable member;

a plunger provided in the housing and configured to move up and down between an top dead center and bottom dead center, the plunger having a blade for impacting the fastener;

an elastic member that urges the plunger downwards and is capable of being compressed upwards;

a connecting member coupled between the plunger and the rotatable member to move the plunger to the top dead center when the rotatable member is driven by the motor;

an energizing switch connected between a power source and the motor to control a power supply to the motor;

a trigger switch that is operated by a user and is configured to turn on the energizing switch when the trigger switch is turned on;

a control unit configured to supply electric power to the motor;

a detection switch configured to detect a rotational position of the rotatable member, the detection switch turning on after the plunger starts to move to the top dead center, and maintaining the ON state at least until the plunger reaches a predetermined position near the top dead center; and a failure detection circuit configured to detect a failure situation when the detection switch is not turned on after the plunger starts to move to the top dead center and to stop supplying the electric power to the motor.

* * * * *